US007118260B2

(12) United States Patent
Tsukamoto et al.

(10) Patent No.: US 7,118,260 B2
(45) Date of Patent: Oct. 10, 2006

(54) LAMP UNIT FOR VEHICLE

(75) Inventors: Michio Tsukamoto, Shizuoka (JP); Naoki Uchida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 59 days.

(21) Appl. No.: 10/998,625

(22) Filed: Nov. 30, 2004

(65) Prior Publication Data

US 2005/0141227 A1 Jun. 30, 2005

(30) Foreign Application Priority Data

Dec. 24, 2003 (JP) ..... P. 2003-426714

(51) Int. Cl.
*F21V 7/00* (2006.01)

(52) U.S. Cl. ..... 362/517; 362/544; 362/243; 362/245; 362/247; 362/307

(58) Field of Classification Search ..... 362/543, 362/516, 517, 518, 297, 346, 243, 245, 247, 362/307

See application file for complete search history.

(56) References Cited

U.S. PATENT DOCUMENTS 5,175,783 A * 12/1992 Tatoh ..... 385/93
6,386,743 B1 * 5/2002 Futami et al. ..... 362/516
6,882,110 B1 * 4/2005 Ishida et al. ..... 315/82
2003/0086277 A1 * 5/2003 Hayakawa et al. ..... 362/513
2003/0185017 A1 * 10/2003 Ishida et al. ..... 362/539

FOREIGN PATENT DOCUMENTS

JP 2002-50214 A 2/2002

* cited by examiner

*Primary Examiner*—Thomas M. Sember
(74) *Attorney, Agent, or Firm*—Sughrue Mion, PLLC

(57) ABSTRACT

In a lamp unit for a vehicle, light incident into a translucent member from a light emitting element is reflected by the inner surface of the translucent member reflecting surface and irradiated from the irradiating surface of the translucent member in the forward direction of the lamp unit. The reflecting surface is vertically shaped as a concave curved formed by a hyperbola. The focusing point is the light emitting center of the light emitting element, whereby the reflecting light is irradiated as spread light from the virtual image position of the light emitting element formed by the reflecting surface within the vertical section. The irradiating surface is vertically shaped as a convex curve formed by an ellipse which focusing point is the virtual image position. The irradiating light can be made substantially parallel rays within the vertical section.

20 Claims, 15 Drawing Sheets

LAMP UNIT FOR VEHICLE

This application claims foreign priority based on Japanese patent application JP 2003-426714, filed on Dec. 24, 2003, the contents of which is incorporated herein by reference in its entirety.

BACKGROUND OF THE INVENTION

1. Field of the Invention

The present invention relates to a lamp unit for a vehicle using a light emitting element such as a light emitting diode as a light source.

2. Description of the Related Art

A related art lamp unit for a vehicle using a light emitting diode as a light source has been employed. For example, JP-A-2002-50214 describes a lamp unit for a vehicle having a light emitting diode directed in the forward direction of the lamp unit and a light transmission (translucent) member that covers the light emitting diode from the front side thereof.

This related art lamp unit is such that light from the light emitting diode incident at the rear end portion of the translucent member thereof is introduced to the front end surface of the translucent member. Then, the light is emitted from the front end portion to irradiate the forward area of the lamp unit through a projection lens. When the translucent member described in the above-mentioned JP-A-2002-50214 is used, the utilization factor of light from the light emitting diode can be improved.

However, since the translucent member is configured in a substantially horn shape, there arise related art problems. For example, but not by way of limitation, the irradiation light from the translucent member cannot be controlled accurately, and the length of the lamp unit in the front-to-rear direction thereof (i.e., the longitudinal direction of a vehicle) becomes longer.

SUMMARY OF THE INVENTION

An object of the present invention is to provide a lamp unit for a vehicle using a light emitting element as a light source, which enhances not only the utilization factor of light from the light emitting element, but also controls irradiation light accurately. Further, the present invention can reduce the length of the lamp unit in the longitudinal direction of a vehicle.

While the foregoing objects are provided for the present invention, it is not necessary for these objects to be achieved in order for the invention to operate properly. Further, other object, or no objects at all, may be achieved by the present invention without affecting its operation.

The invention attains the aforesaid object such that a translucent member is disposed to cover a light emitting element from the front side thereof and an improvement is made to the surface configuration of the translucent member.

More specifically, a lamp unit for a vehicle according to the invention is arranged in such a manner that in the lamp unit for a vehicle comprising a light emitting element disposed in a direction and a translucent member disposed to cover the light emitting element from a forward side of the light emitting element, the lamp unit for a vehicle is characterized in that a part of a surface of the translucent member is configured as a reflecting surface which reflects light, incident into the translucent member from the light emitting element, by an inner surface of the reflecting surface, and another part of the surface of the translucent member is configured as an irradiating surface which irradiates the light, irradiated from the light emitting surface and reflected by the inner surface of the reflecting surface, in a forward direction of the lamp unit, and the reflecting surface is set, in its vertical sectional shape along a plane passing through a light emitting center of the light emitting element, to have a concavely curved shape formed by a hyperbola which focusing point is near the light emitting center, and the irradiating surface is set, in its vertical sectional shape along the plane, to have a convexly curved shape formed by an ellipse which focusing point is near a virtual image position of the light emitting element formed by the reflecting surface.

The "light emitting element" means a light source with an element configuration having a light emitting portion for emitting light of a substantially point shape, and the kind of the light emitting element is not limited to a particular one, and so a light emitting diode, a laser diode etc. may be employed as the light emitting element, for example.

The "direction" is not limited to a particular direction so long as the light, incident into the translucent member from the light emitting element, can be reflected by the inner surface of the reflecting surface and then can be irradiated from the irradiating surface in the forward direction of the lamp unit.

The "translucent member" is not limited in its material to particular one so long as it is a member with translucency, and so a member formed by transparent composite resin, a member formed by glass etc. maybe employed as the translucent member, for example.

The "plane" is not limited in its direction to a particular direction so long as it is a plane passing through the light emitting center of the light emitting element.

Although the "reflecting surface" is set, in its vertical sectional shape along the plane, to have the concavely curved shape formed by the hyperbola, the sectional shape of the reflecting surface along a plane orthogonal to the plane is not limited to a particular shape.

Although the "irradiating surface" is set, in its vertical sectional shape along the plane, to have the convexly curved shape formed by the ellipse, the sectional shape of the irradiating surface along the plane orthogonal to the plane is not limited to a particular shape.

As shown in the aforesaid configuration, in the lamp unit for a vehicle according to the invention, since the translucent member is disposed to cover the light emitting element from the forward side of the light emitting element, the utilization factor of light from the light emitting element can be enhanced.

In this case, since the reflecting surface constituting a part of the surface of the translucent member is set, in its vertical sectional shape along the plane passing through the light emitting center of the light emitting element, to have the concavely curved shape formed by the hyperbola which focusing point is near the light emitting center, the reflecting surface reflects on the inner surface thereof the light incident into the translucent member from the light emitting element in a manner that the light is reflected as if it is emitted from the virtual image position of the light emitting element formed by the reflecting surface, within the plane.

Further, since the irradiating surface constituting another part of the surface of the translucent member is set, in its vertical sectional shape along the plane, to have the convexly curved shape formed by the ellipse which focusing point is near the virtual image position of the light emitting element, the irradiating surface acts to irradiate the light, irradiated from the light emitting element and then reflected by the inner surface of the irradiating surface, in the forward direction of the lamp unit from the translucent member as parallel rays within the plane. In this case, when the eccentricity of the ellipses constituting the convexly curved shape is set to a reciprocal of the refractive index n of the translucent member, the light irradiated from the translucent member can be set to substantially accurate parallel rays.

Thus, even when the length of the translucent member in the longitudinal direction of a vehicle is set to be short, the irradiating light from the translucent member can be controlled accurately.

In this manner, according to the invention, in the lamp unit for a vehicle using a light emitting element as a light source, the utilization factor of light from the light emitting element can be enhanced, and not only the irradiation light from the lamp unit can be controlled accurately but also the length of the lamp unit in the longitudinal direction of a vehicle can be made short.

According to the aforesaid configuration, although the configuration of "the light emitting element" is not limited to a particular one as described above, when the light emitting element is configured to include a light emitting chip and a sealing resin for sealing the light emitting chip and further to integrally form the sealing resin with the translucent member, the configuration of the lamp unit can be simplified. In this case, as a mode at the time of "integrally forming" the sealing resin with the translucent member, there may be employed a mode in which the sealing member is sealed by the translucent member or a mode in which the light emitting chip is directly sealed by the translucent member thereby to make the translucent member also have a function of sealing resin, for example.

In the aforesaid arrangement, when the "reflecting surface" of the translucent member is formed by a hyperboloid of revolution, all the light reflected from the inner surface of the reflecting surface can be irradiated as spread light from the virtual image position of the light emitting element. Thus, the refraction control of the light reflected by the inner surface of the irradiating surface can be facilitated.

In this case, when the "irradiating surface" of the translucent member is formed by an ellipsoid of revolution, all the light irradiated from the irradiating surface in the forward direction of the lamp unit can be made substantially parallel rays, a spot-shaped distribution pattern can be obtained. In this case, when the light irradiated from the translucent member in the forward direction is subjected to a suitable spread and deflection control by using a lens etc., a desired light distribution pattern can be obtained easily.

In the aforesaid configuration, when substantially entire area of the surface of the translucent member is configured by the reflecting surface and the irradiating surface, the utilization factor of lights from the light emitting element can be enhanced to almost the maximum degree.

Additionally, a lamp for a vehicle is provided, comprising a plurality of lamp units housed in a lamp chamber. The plurality of lamp units include a first lamp unit of a projector type, including a substantially transparent projection lens on an optical axis, a first light emitting element positioned at a rear side of said projection lens, and a reflector covering an upper side of said first light emitting element to direct emitted light in a forward direction toward said projection lens. These lamp units also include at least one second lamp unit comprising a second light emitting element that directs light backwards to a translucent member having a reflecting surface that receives and reflects said emitted light from the second light emitting element towards an irradiating surface of said translucent member and in a forward direction of the lamp unit.

Further, a lamp for a vehicle is provided, said lamp comprising a plurality of lamp units housed in a lamp chamber. The plurality of lamp units include a first lamp unit of a projector type, including a substantially transparent projection lens on an optical axis, a first light emitting element positioned at a rear side of said projection lens, and a reflector covering an upper side of said first light emitting element to direct emitted light in a forward direction toward said projection lens. Also, the lamp units include a plurality of second lamp units, each comprising a second light emitting element that directs light backwards to a translucent member having a reflecting surface that receives and reflects said emitted light from the second light emitting element towards an irradiating surface of said translucent member and in a forward direction of the lamp unit. The second type of lamp units include a first one of said second lamp units having a concave shape of said reflecting surface and formed by a hyperbola such that a virtual image of light is formed at a focal point of a hyperboloid of revolution that is conjugate with said reflecting surface, wherein said irradiating surface has a convex shape formed by an ellipse having an eccentricity that is reciprocal of a refractive index of the translucent member, a second one of said second lamp units, wherein said irradiating surface is a substantially elliptical cylindrical or cylindroid surface and said reflecting surface is substantially concave and formed by a hyperbola such that a virtual image of light is formed at a focal point of a hyperboloid of revolution that is conjugate with said reflecting surface, and a third one of said second lamp units, wherein wherein said irradiating surface is a substantially elliptical cylindrical or cylindroid surface and said reflecting surface is a substantially hyperbolic cylindrical surface.

DETAILED DESCRIPTION OF THE INVENTION

Hereinafter, an exemplary, non-limiting embodiment of the present invention will be explained with reference to the accompanying drawings.

Figure 1:
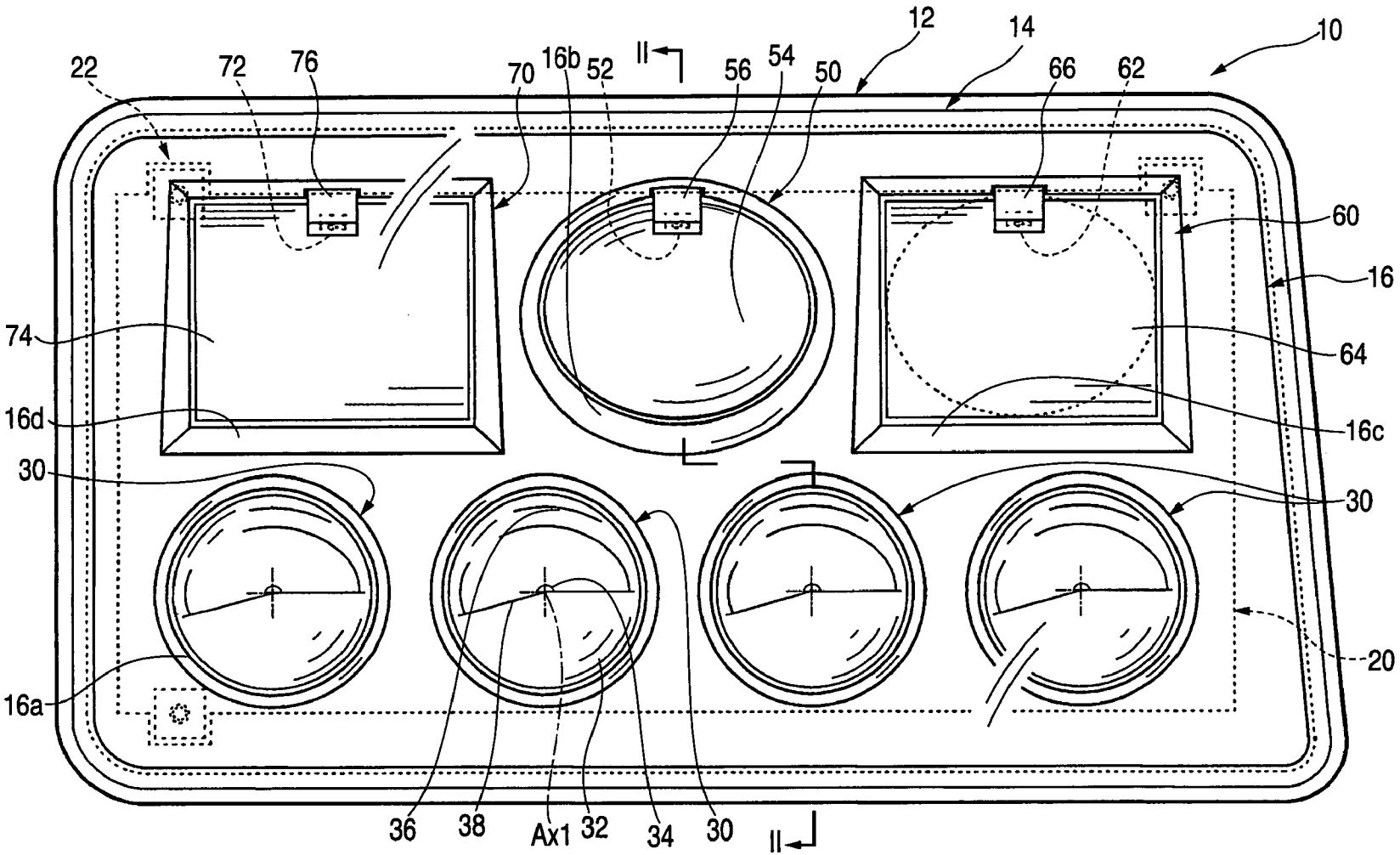
FIG. 1 is a front view showing an illumination lamp for a vehicle according to an exemplary, non-limiting embodiment of the present invention.
Figure 2:
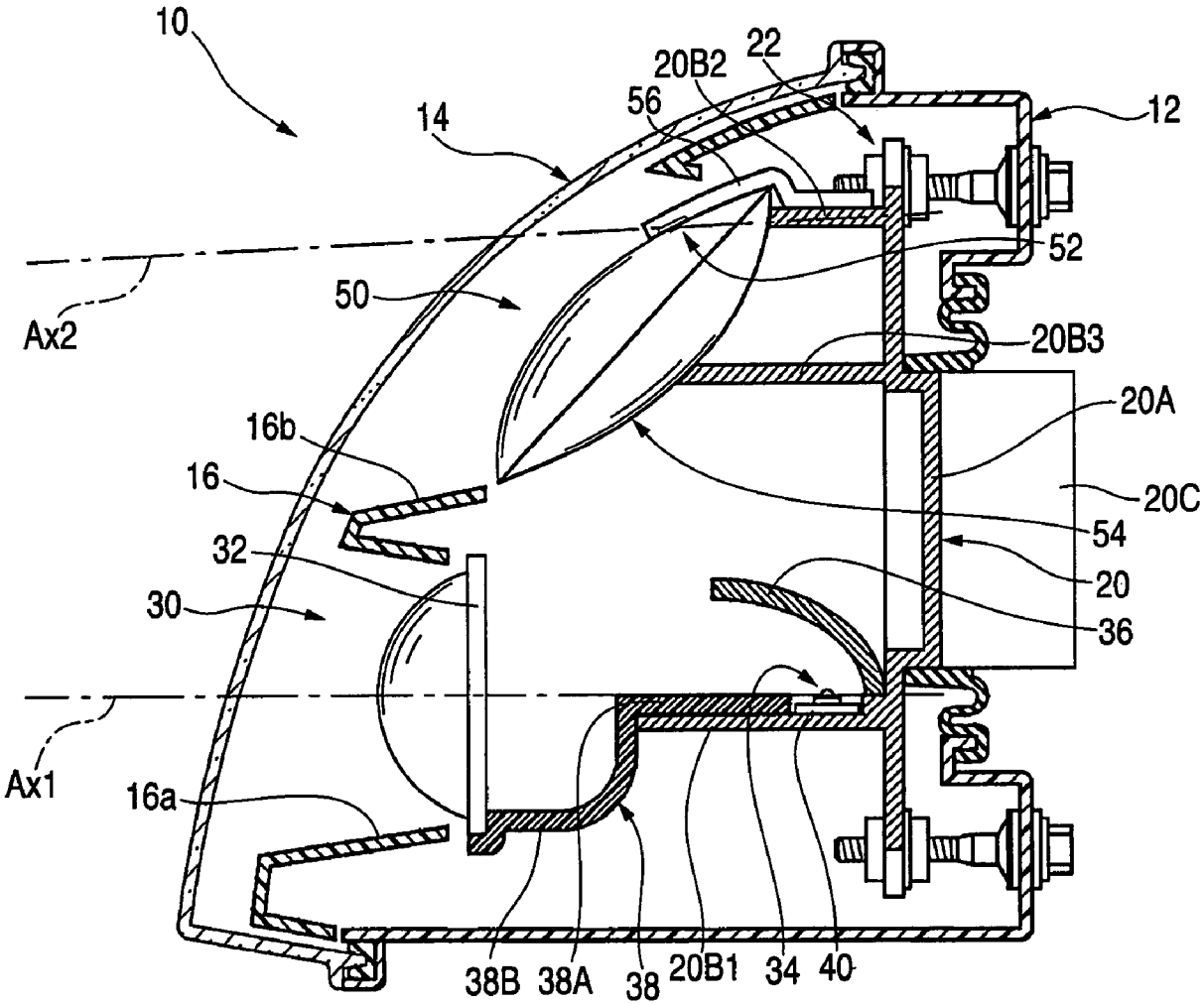
FIG. 2 is a sectional diagram cut along a line II—II in FIG. 1 according to the exemplary, non-limiting embodiment of the present invention.

FIG. 1 is a front view showing an illumination lamp for a vehicle according to the exemplary, non-limiting embodiment of the present invention, and FIG. 2 is a sectional diagram cut along a line II—II in FIG. 1.

An illumination lamp 10 for a vehicle according to the embodiment is a head lamp provided at the right side of the front end portion of a vehicle and is configured in a manner that lamp units 30, 50, 60, 70 are housed within a lamp chamber formed by a lamp body 12 and a translucent cover 14 attached to the opening portion at the front end of the lamp body. For example, but not byway of limitation, the total number of lamp units 30, 50, 60, 70 may be seven, but the present invention is not limited thereto.

The translucent cover 14 extends from the lower end portion thereof toward the upper end portion thereof at the rear side thereof. An inner panel 16 is provided along the translucent cover 14 within the lamp chamber. Cylindrical opening portions 16*a*, 16*b*, 16*c* and 16*d* surround the lamp units 30, 40, 50, 60 and 70 at the positions corresponding to these lamp units of the inner panel 16, respectively.

The lamp units 30, 40, 50, 60 and 70 are inclinable in the vertical and horizontal directions by the lamp body 12 through an aiming mechanism 22 that is attached to a common unit supporting member 20.

The unit supporting member 20 is configured by die-cast parts and is provided with a vertical panel portion 20A, unit attachment portions 20B1, 20B2, 20B3 extending like shelves in the forward direction at plural portions of the vertical panel portion 20A, and a heat sink portion 20C formed by a plurality of radiation fins extending backward from the vertical panel portion 20A to a position exposed to the external space of the lamp.

In the illumination lamp 10 for a vehicle according to the embodiment, a low-beam light distribution pattern is formed by lights irradiated from the lamp units 30, 50, 60 and 70.

Among the lamp units 30, 50, 60 and 70, the lamp units 30 (e.g., four, but not limited thereto) positioned at a lower stage are lamp units for radiating lights that form the basic low-beam light distribution pattern. The three lamp units 50, 60 and 70 positioned at an upper stage are lamp units for radiating lights to reinforce the basic light distribution pattern. In this case, among the three lamp units 50, 60 and 70 positioned at the upper stage, the lamp unit 50 at the center position is a lamp unit for forming a light distribution pattern for converging light, the lamp unit 60 on the inner side in the vehicle width direction is a lamp unit for forming a light distribution pattern for middle area distribution, and the lamp unit 70 on the outer side in the vehicle width direction is a lamp unit for forming a light distribution pattern for wide area distribution.

The four lamp units 30 for forming the basic light distribution pattern are arranged such that optical axes Ax1 thereof extend in a direction substantially orthogonal to the vertical panel portion 20A so as to be parallel from one another. The optical axes Ax1 of the respective lamp units 30 extend downward by substantially 0.5 to 0.6 degrees with respect to the longitudinal direction of a vehicle when the optical axis adjusting process using the aiming mechanism 22 is completed. On the other hand, the optical axes Ax2 of the remaining three lamp units 50, 60 and 70 are directed downward slightly with respect to the optical axes Ax1 of the lamp units 30.

Next, the configurations of the lamp units 30, 50, 60 and 70 will be explained. First, the configuration of the lamp units 30 for forming the basic light distribution pattern will be explained.

Figure 3:
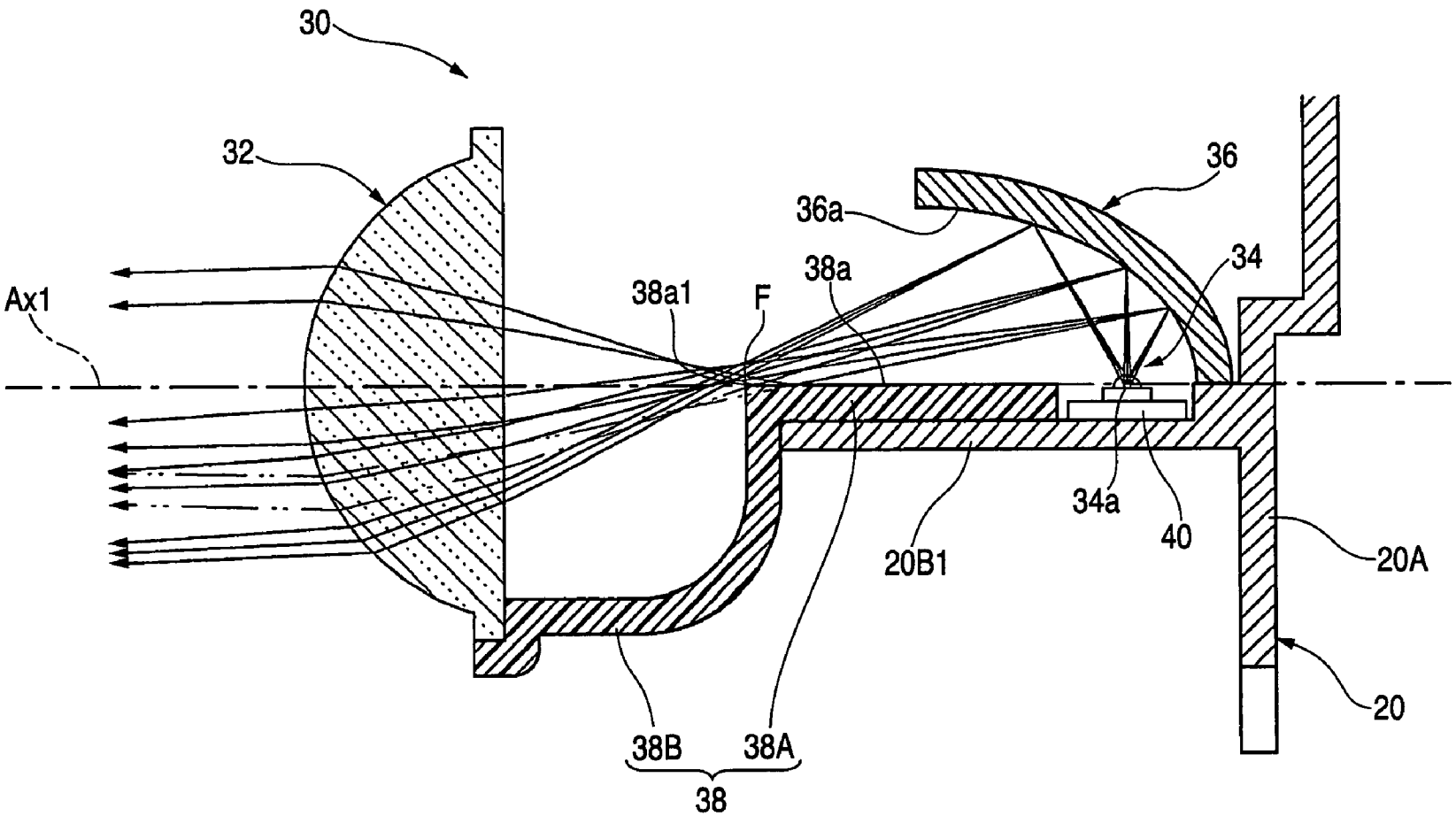
FIG. 3 is a side sectional diagram showing the lamp unit for forming a basic light distribution pattern in the illumination lamp for a vehicle, according to the exemplary, non-limiting embodiment of the present invention.

FIG. 3 is a side sectional diagram showing the lamp unit 30 in detail. The lamp unit 30 is a projector type lamp unit and is provided with a projection lens 32 disposed on the optical axis Ax1, a light emitting element 34 disposed at the rear side of the projection lens 32, a reflector 36 disposed to cover the light emitting element 34 from the upper side thereof, and a straight traveling preventing member 38 disposed between the light emitting element 34 and the projection lens 32.

The projection lens 32 is made of transparent resin and is configured by a plane-convex lens having a front side surface that is formed as a convex plane and rear side surface that is formed as a plane.

The light emitting element 34 is a white light emitting diode having a light emitting chip 34*a* of a substantially 0.3 to 1.0 mm square. The light emitting element is fixed on the unit attachment portion 20B1 of the unit supporting member 20 through a plate 40 such that the light emitting chip 34*a* is disposed upward so as to be directed vertically on the optical axis Ax1.

The reflector 36 is configured to reflect the light emitted from the light emitting element 34 in the forward direction so as to close to the optical axis Ax1 to substantially focus the reflected light near the backward side focusing point F of the projection lens 32. The reflection surface 36*a* of the reflector 36 is set such that the sectional shape including the optical axis Ax1 is substantially elliptical shape and the eccentricity becomes larger gradually from the vertical section toward the horizontal section. The reflection surface 36*a* is arranged to substantially focus the light emitted from the light emitting element 34 at a position slightly forward of the backward side focusing point F. The reflector 36 is fixed at its peripheral lower end portion to the unit attachment portion 20B1 of the unit supporting member 20.

The straight traveling preventing member 38 is configured by a main body portion 38A having its upper surface 38*a* formed in a substantially L-shape when seen from the front side of the lamp. A lens holder portion 38B extends forward from the front end portion of the main body portion 38A.

The upper surface 38*a* of the main body portion 38A extends backward from the backward side focusing point F of the projection lens 32. The left side area (the right side area when seen from the front side of the lamp) with respect to the optical axis Ax1 is formed by a plane extending horizontally to the left direction from the optical axis Ax1, and the right side area with respect to the optical axis Ax1 is formed by a plane extending in an inclined right downward direction (for example, downward by about 15 degrees) from the optical axis Ax1. The front end edge 38*a*1 of the upper surface 38*a* is formed in a substantially arc shape along the focusing surface of the backward side focusing point F of the projection lens 32.

The upper surface 38*a* is subjected to mirror surface processing such as aluminum vapor deposition, such that the upper surface 38*a* is a reflection surface. The main body portion 38A is arranged in a manner that the upper surface 38*a* thereof prevents the straight traveling of a part of the reflection light from the reflection surface 36*a* of the reflector 36 and reflect the part of the reflection light upward. The upper surface 38*a* is fixed at its lower surface to the unit attachment portion 20B1 of the unit supporting member 20.

The lens holder portion 38B bends downward from the front end portion of the main body portion 38A and extends forward thereby to support the projection lens 32 at the front end portion of the lens holder portion.

Figure 4:
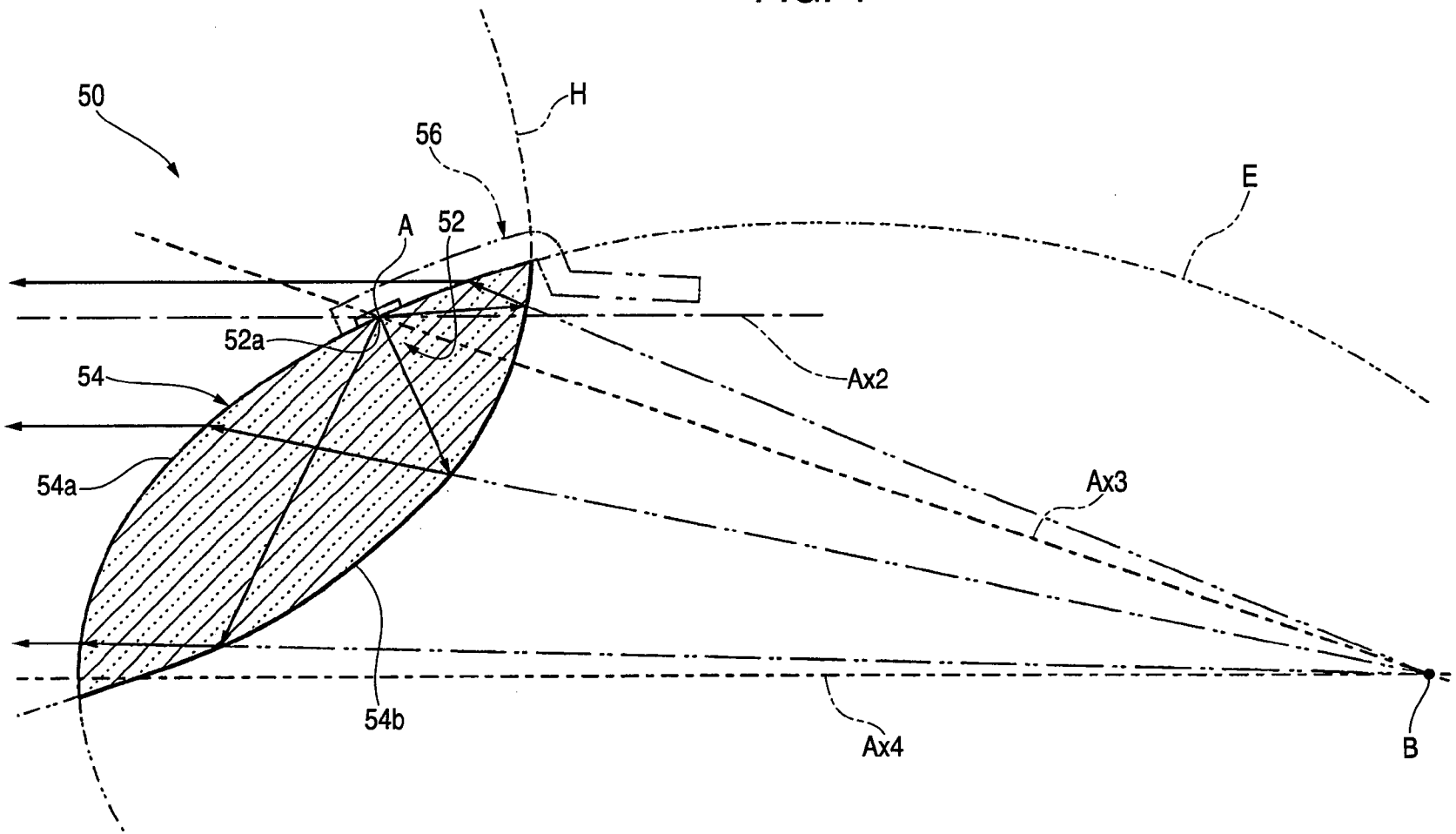
FIG. 4 is a side sectional diagram showing the lamp unit for forming a converging light distribution pattern in the illumination lamp for a vehicle, according to the exemplary, non-limiting embodiment of the present invention
Figure 5:
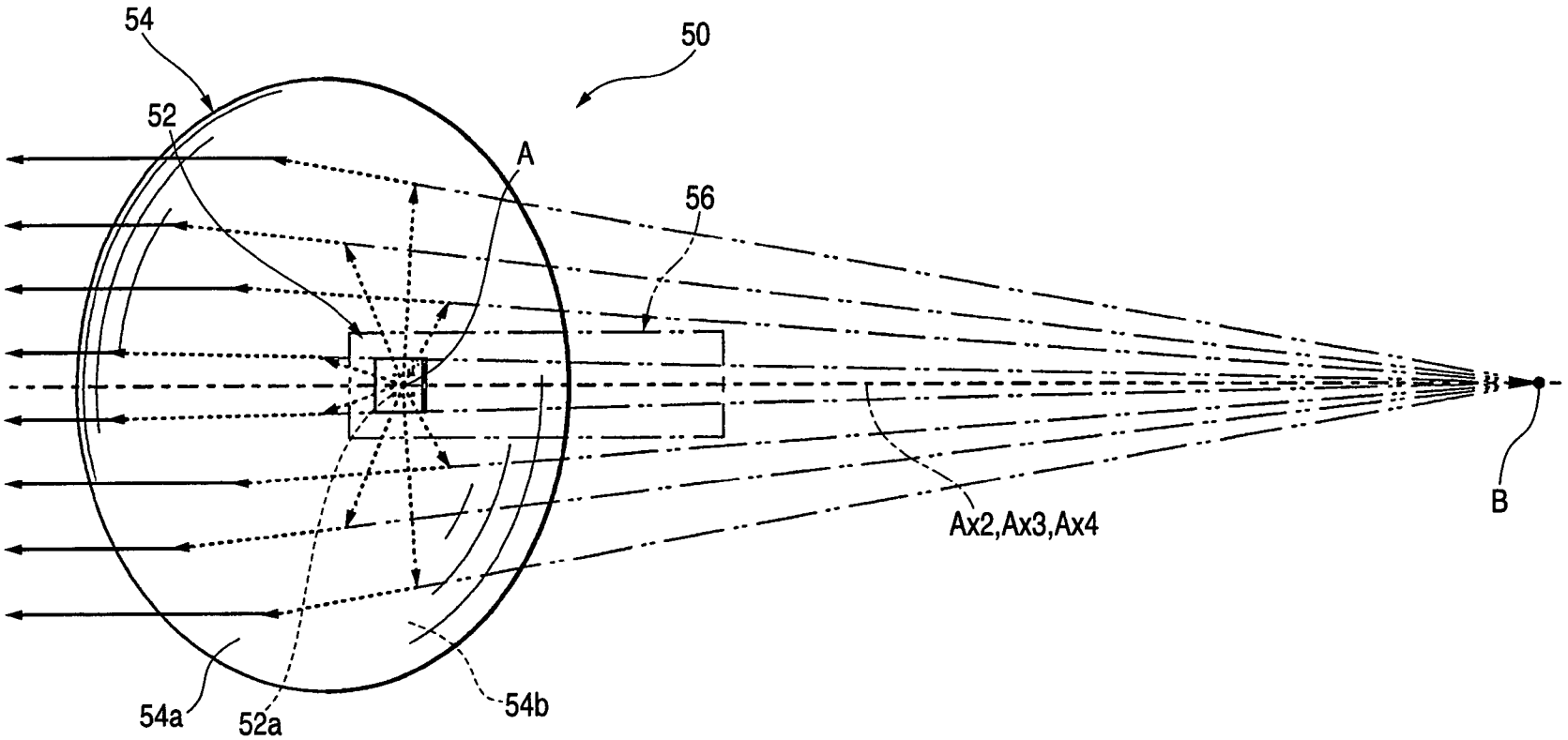
FIG. 5 is a plan view showing the lamp unit for forming the converging light distribution pattern, according to the exemplary, non-limiting embodiment of the present invention.

Next, the configuration of the lamp unit 50 for forming the converging light distribution pattern will be explained. FIG. 4 is a detailed side sectional view showing the lamp unit 50, and FIG. 5 is a plan view thereof. The lamp unit 50 is configured by a light emitting element 52, a translucent member 54 and a supporting bracket 56.

The light emitting element 52 is a white light emitting diode having a light emitting chip 52*a* that is substantially 0.3 to 1.0 mm square and the light emitting element is disposed to direct the light emitting chip 52*a* in a slightly backward direction with respect to the vertically downward direction on an optical axis Ax2.

The translucent member 54 is a member made of transparent resin having a shape substantially similar to a bivalve and is disposed to cover the light emitting element 52 from the forward side thereof (that is, concerning the lamp unit 50, cover the light emitting element from the slightly backward side with respect to the vertically downward direction). The translucent member 54 seals the light emitting chip 52*a* in a manner that the light emitting chip 52*a* of the light emitting element 52 is positioned at the upper portion of the front face of the translucent member.

The rear surface of the translucent member 54 is configured at its entirety as a reflecting surface 54*b* which reflects, on the inner surface thereof, the light incident into the translucent member 54 from the light emitting element 52. In order to realize such a function, the mirror surface processing such as aluminum vapor deposition is performed on the rear surface area of the translucent member 54.

On the other hand, the front surface of the translucent member 54 is configured, at its entire region except for the attachment portion of the supporting bracket 56, as an irradiating surface 54*a* which emits light, irradiated from the light emitting element 52 and then reflected by the inner surface of the reflecting surface 54*b*, in the forward direction of the lamp unit from the translucent member 54.

The reflecting surface 54*b* of the translucent member 54 is set, at its vertical sectional shape including the optical axis Ax2 of the lamp unit 50, to a concavely curved shape formed by a hyperbola H having its focusing point at the light emitting center A of the light emitting element 52.

The reflecting surface 54*b* is configured by a hyperboloid of revolution having a center axis Ax3 which coincides with an axis line passing through the light emitting center A of the light emitting element 52 and extending in the inclined downward and backward direction. The virtual image of the light emitting element 52 (more specifically, the virtual image of the light emitting chip 52*a*) is formed at the focusing point of a hyperboloid of revolution that is conjugate with the hyperboloid of revolution constituting the reflecting surface 54*b*.

The virtual image position B of this virtual image is located at a position in the inclined downward and backward direction with respect to the light emitting center A of the light emitting element 52. The reflecting surface 54*b* reflects by the inner surface thereof the light incident into the translucent member 54 from the light emitting element 52 as if the reflected light is a light spread from the virtual image position B of the light emitting chip 52*a*.

On the other hand, the irradiating surface 54*a* of the translucent member 54 is set, in its vertical sectional shape passing through the light emitting center A of the light emitting element 52, to have a convexly curved shape formed by an ellipse E which focusing point is the virtual image position B of the light emitting element 52.

The reflecting surface 54*b* is configured by an ellipsoid of revolution or a spheroid having a center axis Ax4 which coincides with an axis line extending parallel to the optical axis Ax2 of the lamp unit 50, and also has a focusing point on the backward side which coincides with the virtual image position B. In this case, the eccentricity e of the ellipsoid of revolution constituting the irradiating surface 54*a* is set to a reciprocal of the refractive index n of the translucent member 54 (that is, $e=1/n$). Thus, the irradiating surface acts to irradiate the light, irradiated from the light emitting element 52 and then reflected by the inner surface of the reflecting surface 54*b*, in the forward direction of the lamp unit from the irradiating surface 54*a* as parallel rays along the optical axis Ax2.

The supporting bracket 56 is a member made of metal which extends in the longitudinal direction of a vehicle along the irradiating surface 54*a* at the upper portion of the translucent member 54 and which fixedly supports the light emitting element 52 at the front end portion thereof. The lamp unit 50 is fixedly supported at its rear end portion by the unit attachment portion 20B2 of the unit supporting member 20. In this case, the lamp unit 50 is positioned at and supported by the unit attachment portion 20B3 of the unit supporting member 20 at the rear surface of the translucent member 54.

Figure 6:
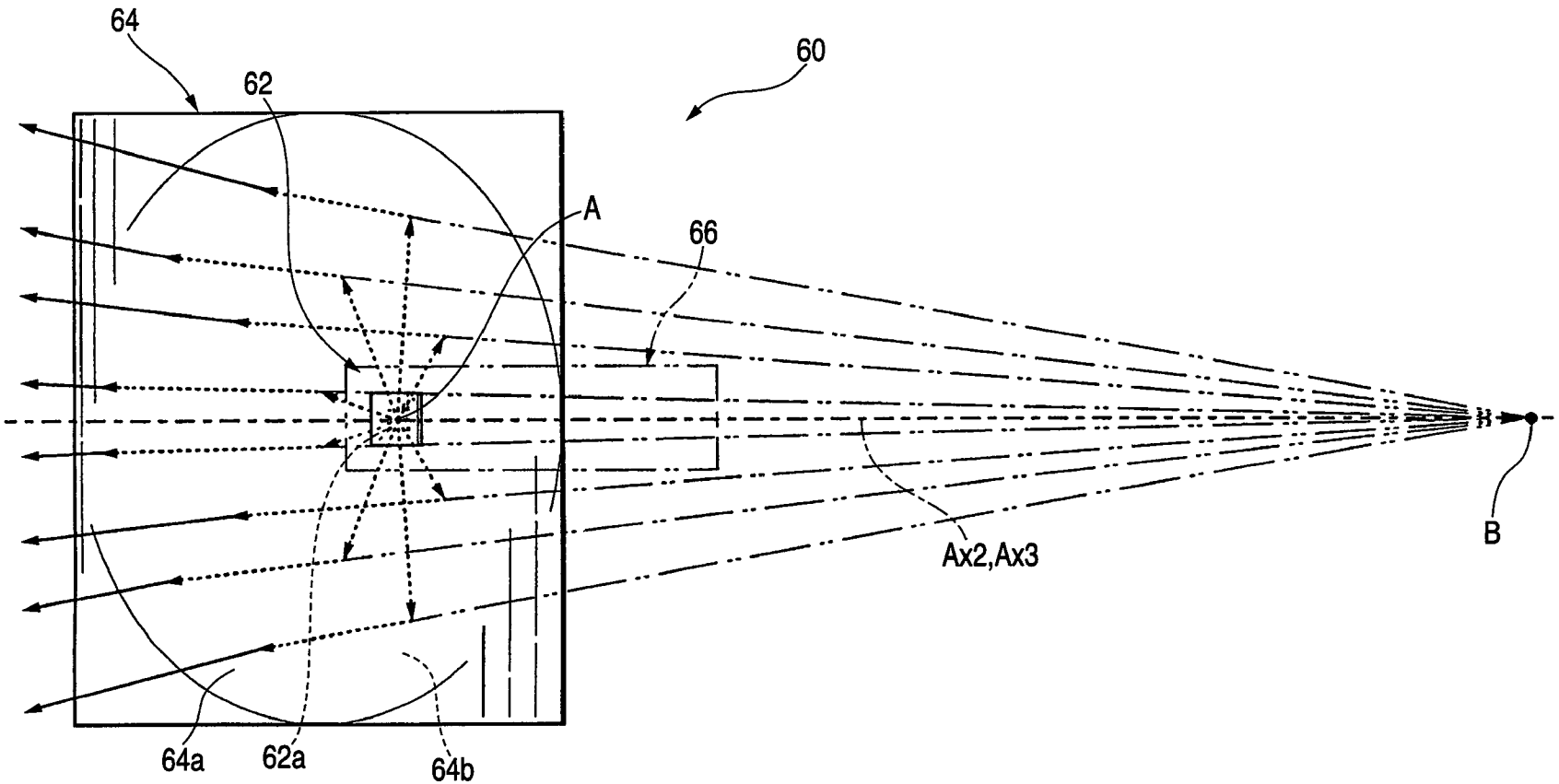
FIG. 6 is a plan view of the lamp unit for forming a middle-area light distribution pattern in the illumination lamp for a vehicle, according to the exemplary, non-limiting embodiment of the present invention.

Next, the configuration of the lamp unit 60 for forming the middle-area light distribution pattern will be explained. FIG. 6 is a detailed plan view of the lamp unit 60. The lamp unit 60 is configured by a light emitting element 62, a translucent member 64 and a supporting bracket 66. The configurations of the light emitting element 62 and the supporting bracket 66 are substantially similar to the light emitting element 52 and the supporting bracket 56 of the lamp unit 50.

The translucent member 64 is made of transparent resin like the translucent member 54 of the lamp unit 50. The rear surface of this translucent member is configured as a reflecting surface 64*b* which reflects, on the inner surface thereof, the light incident into the translucent member 64 from the light emitting element 62. The front surface of this translucent member is configured as an irradiating surface 64*a* which emits light, irradiated from the light emitting element 62 and then reflected by the inner surface of the reflecting surface 64*b*, in the forward direction of the lamp unit from the translucent member 64.

The shape of the reflecting surface 64*b* of the translucent member 64 is same as that of the reflecting surface 54*b* of the translucent member 54, whilst the shape of the irradiating surface 64*a* differs from that of the irradiating surface 54*a* of the translucent member 54.

That is, like the irradiating surface 54*a* of the translucent member 54, the irradiating surface 64*a* of the translucent member 64 is set, in its vertical sectional shape passing through the light emitting center A of the light emitting element 62, to have a convexly curved shape formed by an ellipse which focusing point coincides with the virtual image position B of the light emitting element 62. Then, this irradiating surface is configured as an elliptic cylindrical or cylindroid surface in which such a vertical sectional shape is extended in the horizontal direction as it is. Thus, this irradiating surface acts so that the light, irradiated from the light emitting element 62 and then reflected by the inner surface of the reflecting surface 64*b*, is irradiated from the irradiating surface 64*a* as parallel rays along the optical axis Ax2 as to the vertical direction, whilst, as to the horizontal direction, irradiated from the irradiating surface as spread light being spread to some extent in the horizontal direction around the optical axis Ax2.

Figure 7:
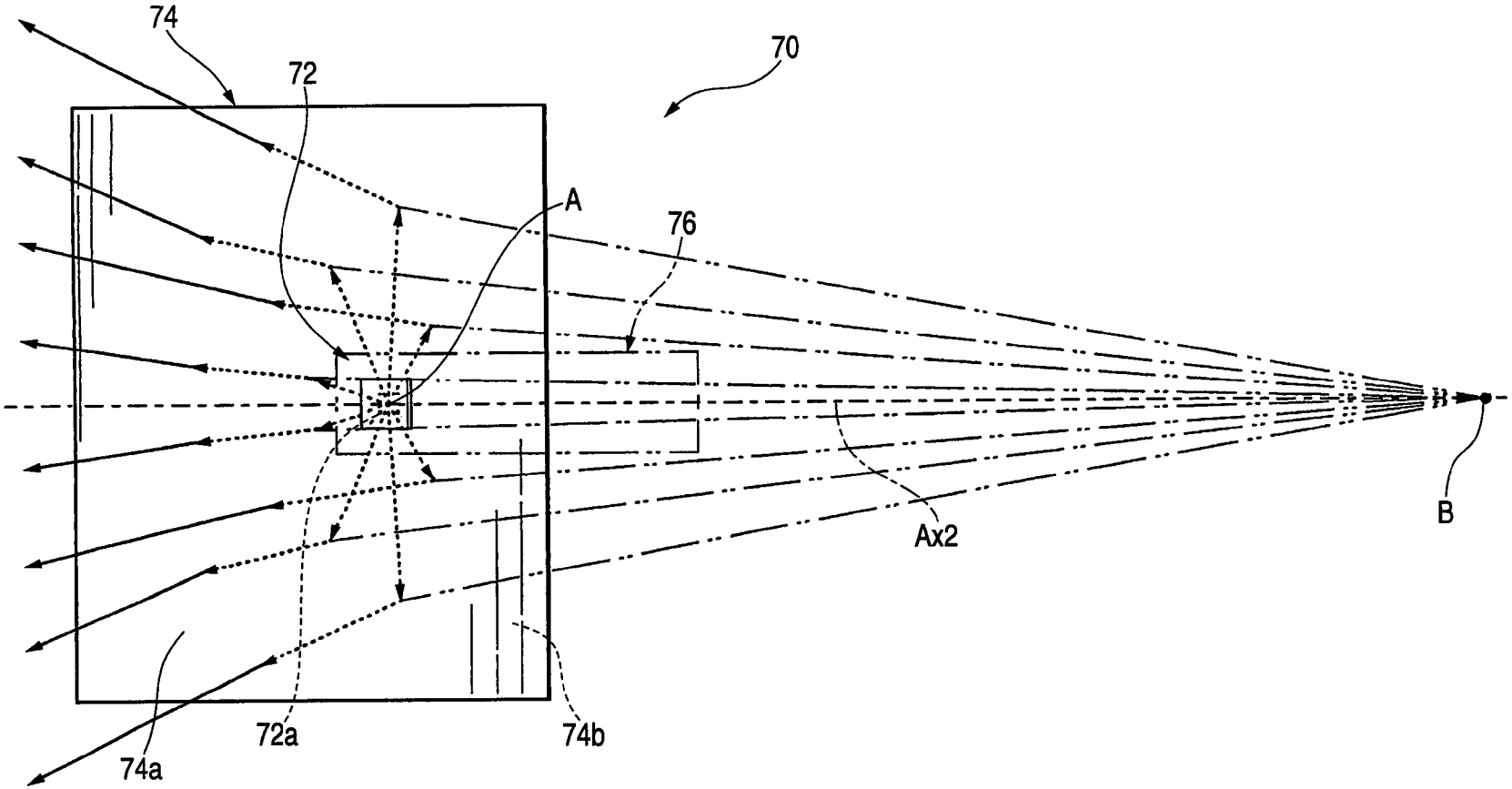
FIG. 7 is a plan view of the lamp unit for forming a wide-area light distribution pattern in the illumination lamp for a vehicle, according to the exemplary, non-limiting embodiment of the present invention.

Next, the configuration of the lamp unit 70 for forming the wide-area light distribution pattern will be explained. FIG. 7 is a plan view showing the lamp unit 70. The lamp unit 70 is configured by a light emitting element 72, a translucent member 74 and a supporting bracket 76.

The configurations of the light emitting element 72 and the supporting bracket 76 are same as the light emitting element 62 and the supporting bracket 66 of the lamp unit 60.

The translucent member 74 is made of transparent resin like the translucent member 64 of the lamp unit 60. The rear surface of this translucent member is configured as a reflecting surface 74*b* which reflects, on the inner surface thereof, the light incident into the translucent member 74 from the light emitting element 72. The front surface of this translucent member is configured as an irradiating surface 74*a* which emits light, irradiated from the light emitting element 72 and then reflected by the inner surface of the reflecting surface 74*b*, in the forward direction of the lamp unit from the translucent member 74.

The shape of the irradiating surface 74*a* of the translucent member 74 is same as that of the irradiating surface 64*a* of the translucent member 64, whilst the shape of the reflecting surface 74*b* differs from that of the reflecting surface 64*b* of the translucent member 64.

Like the reflecting surface 64*b* of the translucent member 64, the reflecting surface 74*b* of the translucent member 74 is set, in its vertical sectional shape passing through the light emitting center A of the light emitting element 72, to have a concavely curved shape formed by a hyperbola which focusing point coincides with the light emitting center A of the light emitting element 72. Then, this irradiating surface is configured as a hyperbolic cylindrical surface in which such a vertical sectional shape is extended in the horizontal direction as it is.

Thus, the reflecting surface 74*b* reflects on the inner surface thereof the light incident into the translucent member 74 from the light emitting element 72 such that the light is reflected as spread light as if it is emitted from the virtual image position B of the light emitting element 72 as to the vertical direction, whilst, as to the horizontal direction, emitted as spread light which spreads in the horizontal direction around the optical axis Ax2 to a larger extent as compared with the spread light emitted from the virtual image position B.

Accordingly, this irradiating surface acts such that the light, irradiated from the light emitting element 72 and then reflected by the inner surface of the reflecting surface 74*b*, is irradiated from the irradiating surface 74*a* as parallel rays along the optical axis Ax2 as to the vertical direction, whilst, as to the horizontal direction, irradiated from the irradiating surface as spread light being spread to a large extent in the horizontal direction around the optical axis Ax2.

Figure 8:
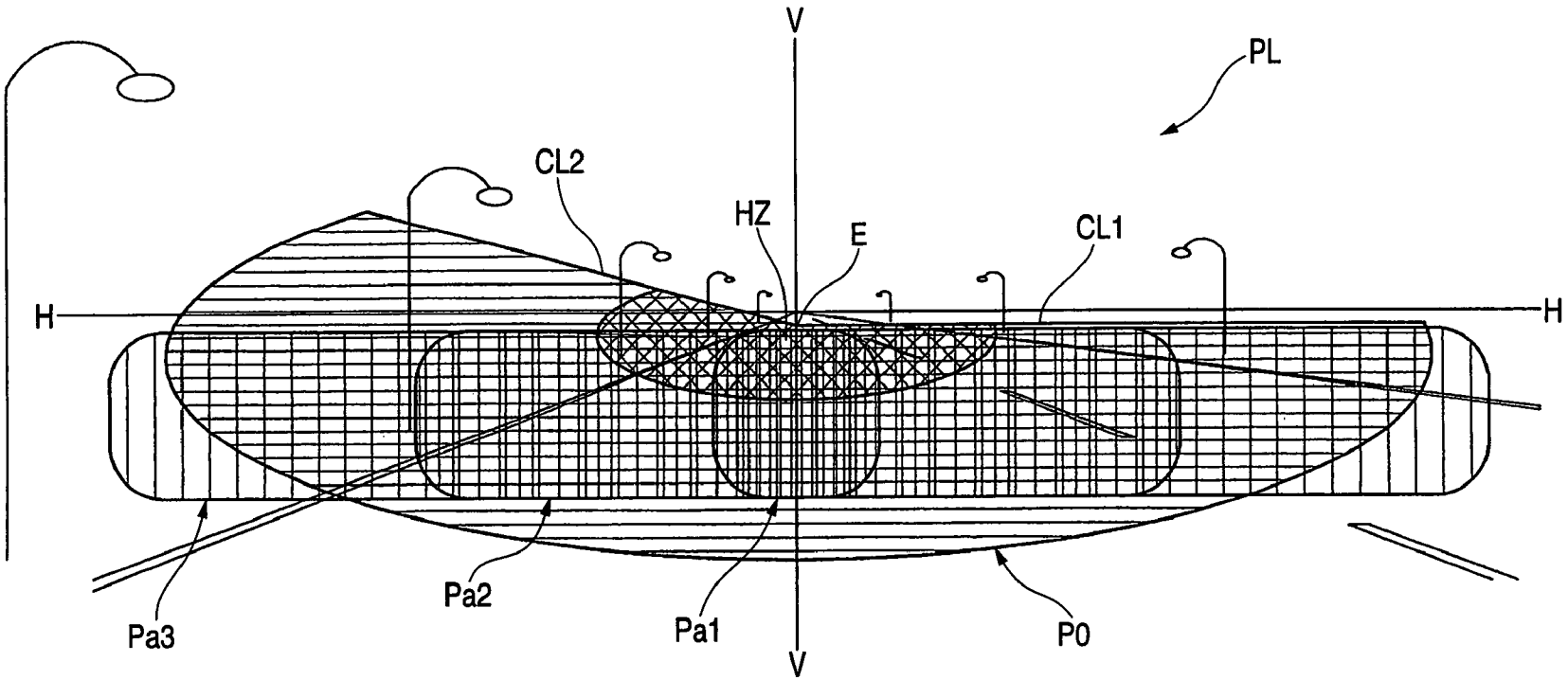
FIG. 8 is a perspective diagram of the low-beam light distribution pattern formed in the forward direction from the illumination lamp for a vehicle, according to the exemplary, non-limiting embodiment of the present invention.
Figure 9A:
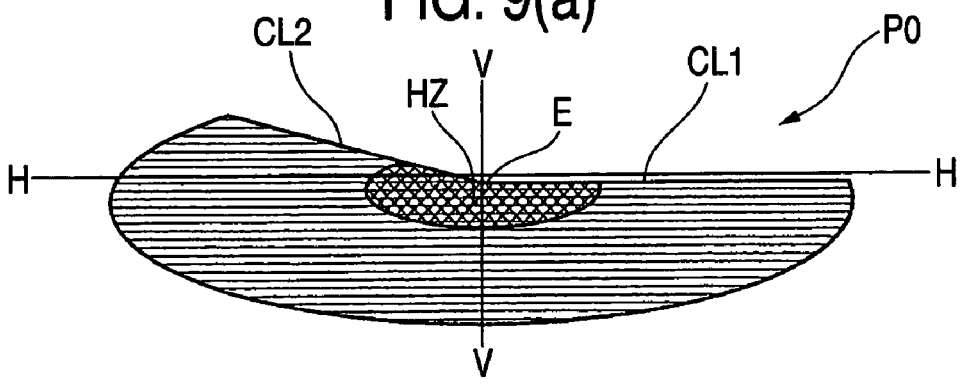
FIGS. 9(*a*)–(*d*) are diagrams showing four kinds of light distribution patterns constituting the low-beam light distribution pattern, according to the exemplary, non-limiting embodiment of the present invention.
Figure 9B:
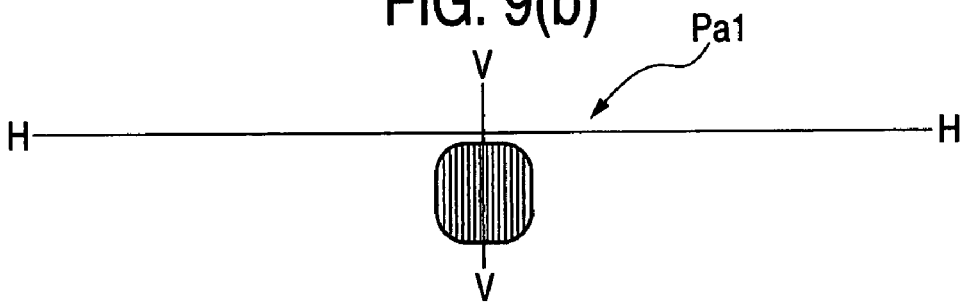
Figure 9C:
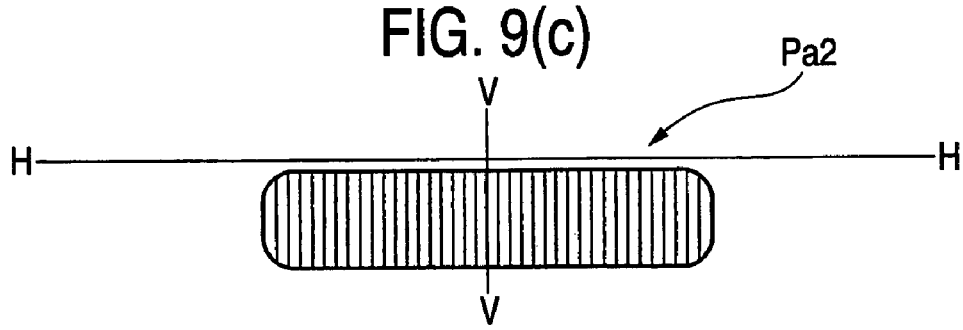
Figure 9D:
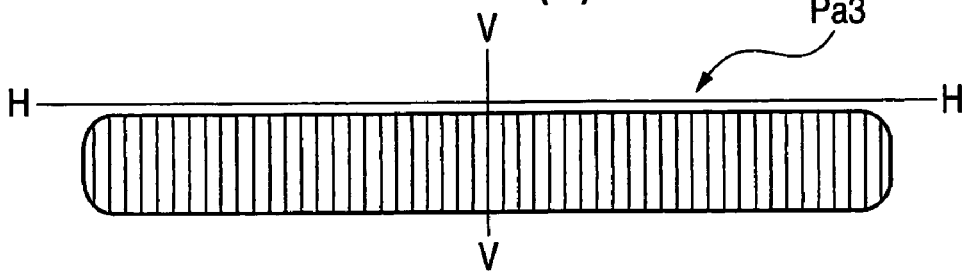

FIG. 8 is a diagram showing the low-beam light distribution pattern formed on a phantom vertical screen disposed at a position about 25 m ahead of the lamp by light irradiated in the forward direction from the illumination lamp 10 for a vehicle according to the embodiment of the present invention.

The low-beam light distribution pattern PL is the light distribution pattern of the left distribution light and includes at its upper end edge a horizontal cut-off line CL1 and a slanted cut-off line CL2 which rises with an angle (for example, about 15 degrees, but not limited thereto) from the horizontal cut-off line CL1. An elbow point E which is a cross point between the both cut-off lines CL1 and CL2 is set at a position below by substantially 0.5 to 0.6 degree from a vanishing point H-V in the straight ahead of the lamp. In the low-beam light distribution pattern PL, a hot zone HZ as a high luminance area is formed to surround the elbow point E.

This low-beam light distribution pattern PL is formed as a composite light distribution pattern of four basic light distribution patterns P0 formed in a superimposed manner at the substantially same position by the lights irradiated from the four lamp units 30, a small-area light distribution pattern Pa1 formed by the light irradiated from the lamp unit 50, a middle-area light distribution pattern Pa2 formed by the light irradiated from the lamp unit 60 and a large-area light distribution pattern Pa3 formed by the light irradiated from the lamp unit 70.

As shown in FIG. 9(*a*), in the basic light distribution pattern P0 formed by the lights irradiated from the lamp units 30, the horizontal and slanted cut-off lines CL1, CL2 are formed as inverted projection images of the front end edge 38*a*1 of the upper surface 38*a* of the main body portion 38A in the straight traveling preventing member 38. In this case, since the upper surface 38*a* of the main body portion 38A is formed as a reflection surface, as shown by two-dot chain lines in FIG. 3, the lights emitted upward from the projection lens 32 among the reflection lights from the reflection surface 36*a* of the reflector 36 are also used as the lights emitted downward from the projection lens 32 as shown by steady lines in this figure due to the reflecting action of the upper surface 38*a*. Thus, the utilization factor of light emitted from the light emitting element 34 can be enhanced, and the hot zone HZ is formed.

On the other hand, as shown in FIG. 9(*b*), the converging light distribution pattern Pa1 formed by the light irradiated from the lamp unit 50 is a light distribution pattern formed as a projection image of the light emitting chip 52*a* of the light emitting element 52, and configured as a spot-shaped distribution pattern with substantially square configuration.

Further, as shown in FIG. 9(*c*), the middle-area light distribution pattern Pa2 formed by the light irradiated from the lamp unit 60 is a light distribution pattern which is formed as a spread projection image of the light emitting chip 62*a* of the light emitting element 62 and configured as a wide distribution pattern spread to some extent in the horizontal direction.

Furthermore, as shown in FIG. 9(*d*), the wide-area light distribution pattern Pa3 formed by the light irradiated from the lamp unit 70 is a light distribution pattern which is formed as a spread projection image of the light emitting chip 72*a* of the light emitting element 72 and configured as a wide distribution pattern spread to a large extent in the horizontal direction.

Each of the converging light distribution pattern Pa1, the middle-area light distribution pattern Pa2 and the wide-area light distribution pattern Pa3 is positioned at its upper end edge slightly below the horizontal cut-off line CL1. This is because the optical axis Ax2 of each of the lamp units 50, 60, 70 is directed slightly downward with respect to the optical axis Ax1 of the lamp unit 30.

The illumination lamp 10 for a vehicle according to the embodiment is provided with the four kinds of the lamp units 30, 50, 60, and 70. The lamp units 50, 60, 70 among these lamp units are arranged such that the translucent members 54, 64, 74 are disposed to cover the light emitting elements 52, 62, 72 from the front sides thereof, respectively. Thus, the utilization factor of lights from the light emitting elements 52, 62, 72 can be enhanced.

In this case, the reflecting surfaces 54*b*, 64*b*, 74*b* constituting the rear surfaces of the translucent members 54, 64, 74 are set, in their vertical sectional shapes passing through the light emitting centers A of the light emitting elements 52, 62, 72, each to have the concavely curved shape formed by the hyperbola H which focusing point coincides with the light emitting center A of the corresponding light emitting element, respectively. Thus, the reflecting surfaces 54*b*, 64*b*, 74*b* reflect on the inner surfaces thereof the lights incident into the translucent members 54, 64, 74 from the light emitting elements 52, 62, 72 such that the lights are reflected as spread lights as if they are emitted from the virtual image positions B of the light emitting chips 52*a*, 62*a*, 72*a* of the light emitting elements 52, 62, 72 as to the aforesaid vertical sections, respectively.

Further, the irradiating surfaces 54*a*, 64*a*, 74*a* constituting the front surfaces of the translucent members 54, 64, 74 are set, in their aforesaid vertical sectional shapes, each to have the convexly curved shape formed by the ellipse E which focusing point coincides with the virtual image position B of the corresponding one of the light emitting chips 52*a*, 62*a*, 72*a*, respectively. Thus, the irradiating surfaces 54*a*, 64*a*, 74*a* act such that the lights, irradiated from the light emitting elements 52, 62, 72 and then reflected by the inner surfaces of the reflecting surfaces 54*b*, 64*b*, 74*b*, are irradiated from the translucent members 54, 64, 74 in the forward direction of the lamp units as substantially parallel rays as to the aforesaid vertical sections, respectively.

Thus, the irradiation lights from the translucent members 54, 64, 74 can be controlled accurately despite setting the lengths of the translucent members 54, 64, 74 in the longitudinal direction of a vehicle to be substantially short.

In this manner, the utilization factor of lights from the light emitting elements 52, 62, 72 can be substantially enhanced, and not only the irradiation lights from the lamp units 50, 60, 70 can be controlled accurately, but also the lengths of the lamp units in the longitudinal direction of a vehicle can be made short.

In particular, since the eccentricities of the ellipses E constituting the irradiating surfaces 54*a*, 64*a*, 74*a* are set to reciprocals 1/n of the refractive indexes n of the translucent members 54, 64, 74, respectively, each of the lights irradiated from the translucent members 54, 64, 74 can be set to accurate parallel rays within the aforesaid vertical section and hence the irradiation lights can be controlled further accurately.

Further, in the translucent members 54, 64, since each of the reflecting surfaces 54*b*, 64*b* is configured by the hyperboloid of revolution, the lights reflected by the inner surfaces of the reflecting surfaces 54*b*, 64*b* are irradiated as spread lights from the virtual image positions B of the light emitting chips 52*a*, 62*a*, respectively. Thus, the refraction control of the lights reflected by the inner surfaces of the irradiating surfaces 54*a*, 64*a* can be facilitated.

In this case, the translucent member 54 is configured at its irradiating surface 54*a* by the ellipsoid of revolution. All the lights irradiated in the forward direction of the lamp unit from the irradiating surface 54*a* can be made as parallel rays, whereby a spot-shaped distribution pattern an be formed.

Further, the translucent members 54, 64, 74 are configured such that the vertical sectional shapes of these translucent members passing through the light emitting centers A of the light emitting elements 52, 62, 72 are maintained in the same shapes, whilst the horizontal shapes thereof are differentiated from one another, thereby forming the converging light distribution pattern Pa1, the middle-area light distribution pattern Pa2 and the wide-area light distribution pattern Pa3, respectively. Thus, the basic light distribution pattern P0 of the low-beam light distribution pattern PL can be reinforced without causing large unevenness of the light distribution on a road in the forward direction of a vehicle.

Additionally, since substantially entire areas of the surfaces of the translucent members 54, 64, 74 are configured by the reflecting surfaces 54*b*, 64*b*, 74*b* and the irradiating surfaces 54*a*, 64*a*, 74*b*, respectively, the utilization factor of lights from the light emitting elements 52, 62, 72 can be enhanced to almost the maximum degree.

Further, since each of the translucent members 54, 64, 74 is configured to have a shape like a bivalve or a shape formed by slightly angulating a bivalve, which extends forwardly in an oblique downward direction. Thus, like the illumination lamp 10 for a vehicle according to the embodiment, even when the translucent cover 14 is formed to extend from the lower end portion thereof toward the upper end portion thereof at the rear side thereof, the lamp units 50, 60 and 70 can be disposed without the lamp chamber without difficulty. Further, since each of the irradiating surfaces 54*a*, 64*a*, 74*a* of the translucent members 54, 64, 74 has a vertical section of the elliptical shape, the translucent members can be matched with the curved shape of the translucent cover 14. Thus, a sense of incongruity concerning the design can be eliminated.

Furthermore, since the translucent members 54, 64, 74 are configured also to have a function of the sealing resin for sealing the light emitting chips 52*a*, 62*a*, 72*a* of the light emitting elements 52, 62, 72, the configuration of each of the lamp units 50, 60, 70 can be simplified.

In the aforesaid embodiment, although the translucent members 54, 64, 74 are explained in a manner that the focusing points of the hyperbolas H constituting the vertical sectional shapes of the reflecting surfaces 54*b*, 64*b*, 74*b* are positioned at the light emitting centers A of the light emitting elements 52, 62, 72 and that the focusing points of the ellipses E constituting the vertical sectional shapes of the irradiating surfaces 54*a*, 64*a*, 74*a* are positioned at the virtual image positions B of the light emitting chips 52*a*, 62*a*, 72*a*, respectively, the action and technical effects similar to those of the aforesaid embodiment can be obtained so long as the focusing point of the hyperbola H is positioned near the corresponding light emitting center A and the focusing point of the ellipse E is positioned near the corresponding virtual image position B.

Although the illumination lamp 10 for a vehicle according to the embodiment is configured to include the seven lamp units 30, 50, 60, 70, the total number of these respective lamp units may be set to another number.

Further, in the illumination lamp 10 for a vehicle according to the embodiment, the explanation is made that the basic light distribution pattern P0 of the low-beam light distribution pattern PL is formed by the lights irradiated from the four projector type lamp units 30. However, this basic light distribution pattern may be formed by using a lamp unit other than the lamp units 30.

Although the illumination lamp 10 for a vehicle according to the embodiment is configured such that only the lamp units 30, 50, 60, 70 for forming the low-beam light distribution pattern PL are housed within the lamp chamber, the lamp units for forming a high-beam light distribution pattern may also be housed within the same lamp chamber.

The illumination lamp 10 for a vehicle according to the embodiment is explained as the head lamp provided at the right side of the front end portion of a vehicle. However, even in the case where the illumination lamp for a vehicle according to the embodiment is used as a head lamp provided at the left side of the front end portion of a vehicle or as an illumination lamp for a vehicle other than the head lamp such as an adverse weather lamp or a fog lamp, the action and technical effects similar to those of the aforesaid embodiment can be obtained so long as the configuration similar to that of the aforesaid embodiment is employed.

Figure 10:
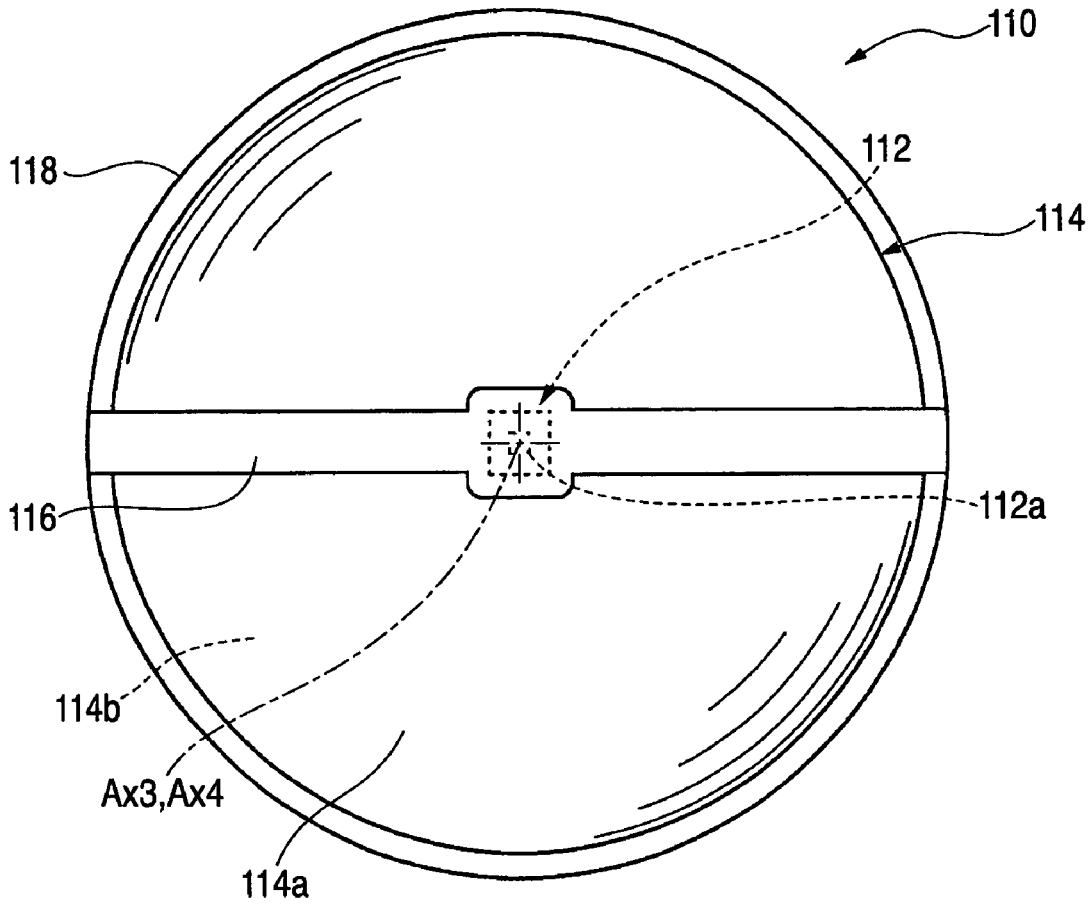
FIG. 10 is a plan view showing a lamp unit according to the first modified example of the embodiment.
Figure 11:
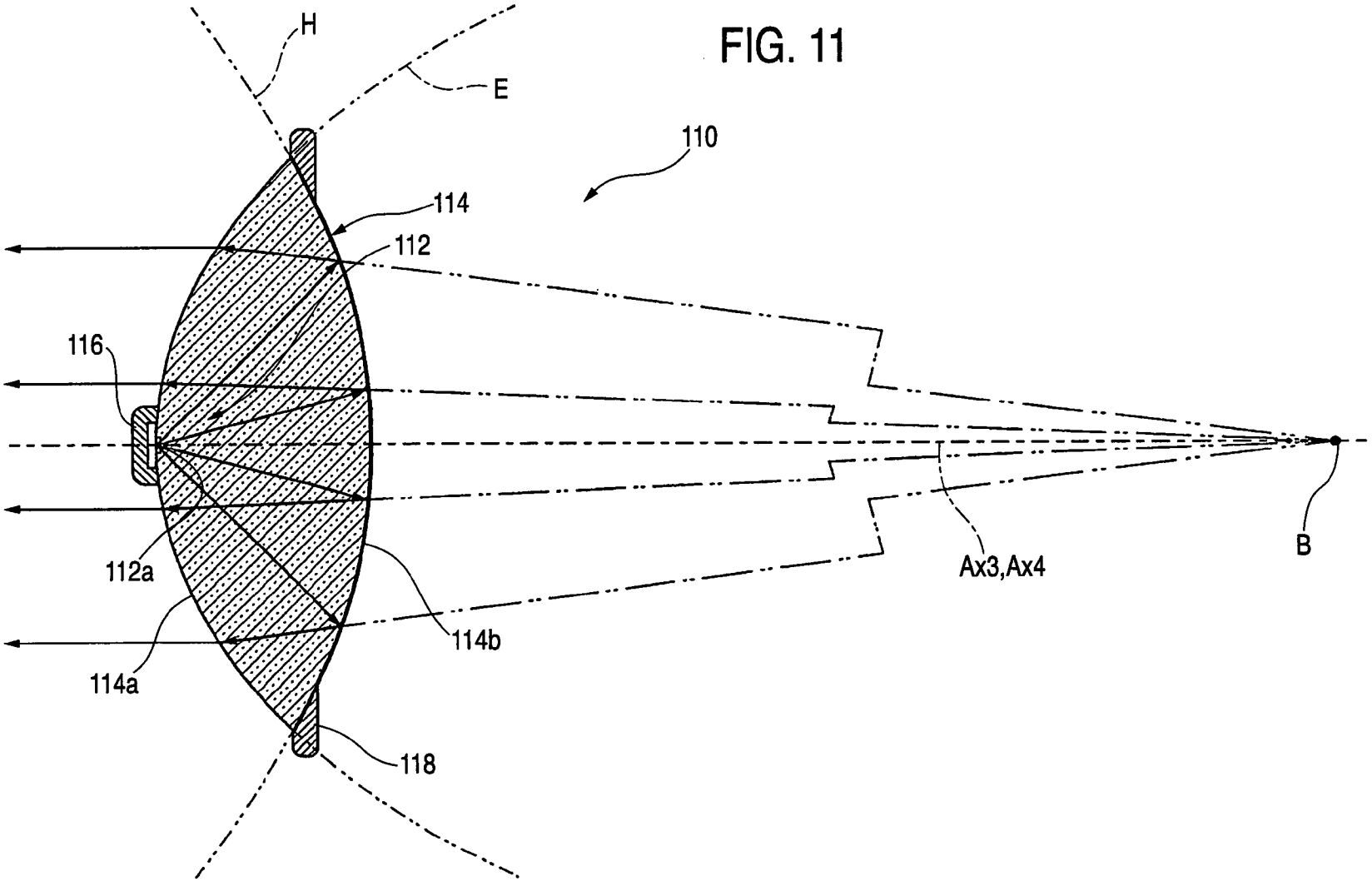
FIG. 11 is a side sectional view showing the lamp unit according to a first modified example of the present invention.

FIG. 10 is a front view showing a lamp unit 110 according to a first modified example and FIG. 11 is a side sectional view thereof. The lamp unit 110 is configured by a light emitting element 112, a translucent member 114 and a supporting bracket 116.

The configuration of the light emitting element 112 itself is same as the light emitting element 52 of the lamp unit 50 of the aforesaid embodiment.

The translucent member 114 is made of transparent resin like the translucent member 54 of the lamp unit 50, and the rear surface of the translucent member is configured as a reflecting surface 114*b* which reflects, on the inner surface thereof, the light incident into the translucent member 114 from the light emitting element 112, whilst the front surface of the translucent member is configured as an irradiating surface 114*a* which emits light, irradiated from the light emitting element 112 and then reflected by the inner surface of the reflecting surface 114*b*, in the forward direction of the lamp unit from the translucent member 114.

The surface configurations of the reflecting surface 114*b* and the irradiating surface 114*a* of the translucent member 114 are substantially similar to the reflecting surface 54*b* and the irradiating surface 54*a* of the translucent member 54. However, the outer configuration of the reflecting surface and the irradiating surface of the translucent member 114 are substantially different from those of the reflecting surface and the irradiating surface of the aforesaid embodiment. Further, the arrangement of the light emitting element 112 differs from that of the light emitting element of the aforesaid embodiment.

In this modified example, the outer configuration of each of the reflecting surface 114*b* and the irradiating surface 114*a* is set to a circle when seen from the front side, and the center axis Ax3 of the hyperboloid of revolution constituting the reflecting surface 114*b* and the center axis Ax4 of the ellipsoid of revolution constituting the irradiating surface 114*a* are set as the same axis line passing through the center of the reflecting surface 114*b* and the irradiating surface 114*a*. The light emitting element 112 is disposed at the center of the irradiating surface 114*a*.

The supporting bracket 116 is a member made of metal which extends in the horizontal direction along the irradiating surface 114*a* of the translucent member 114 and is arranged such that the light emitting element 112 is fixedly supported by the center portion of the supporting bracket and both end portions of the supporting bracket are coupled to and fixed to a metal supporting ring 118 disposed along the outer periphery of the irradiating surface 114*a* of the translucent member 114.

The lamp unit 110 according to this modified example is also arranged such that the light incident into the translucent member 114 from the light emitting element 112 is reflected by the inner surface of the reflecting surface 114*b* of the translucent member 114 as spread light emitted from the virtual image position B of a light emitting chip 112*a* and then irradiated from the irradiating surface 114*a* in the forward direction of the lamp unit as parallel rays along the center axis Ax4.

Also, in the case of employing the configuration of this modified example, the utilization factor of light from the light emitting element 112 can be enhanced. Further, and not only can the irradiation light from the lamp unit 110 be controlled accurately, but also the length of the lamp unit in the longitudinal direction of a vehicle can be made short.

Figure 12:
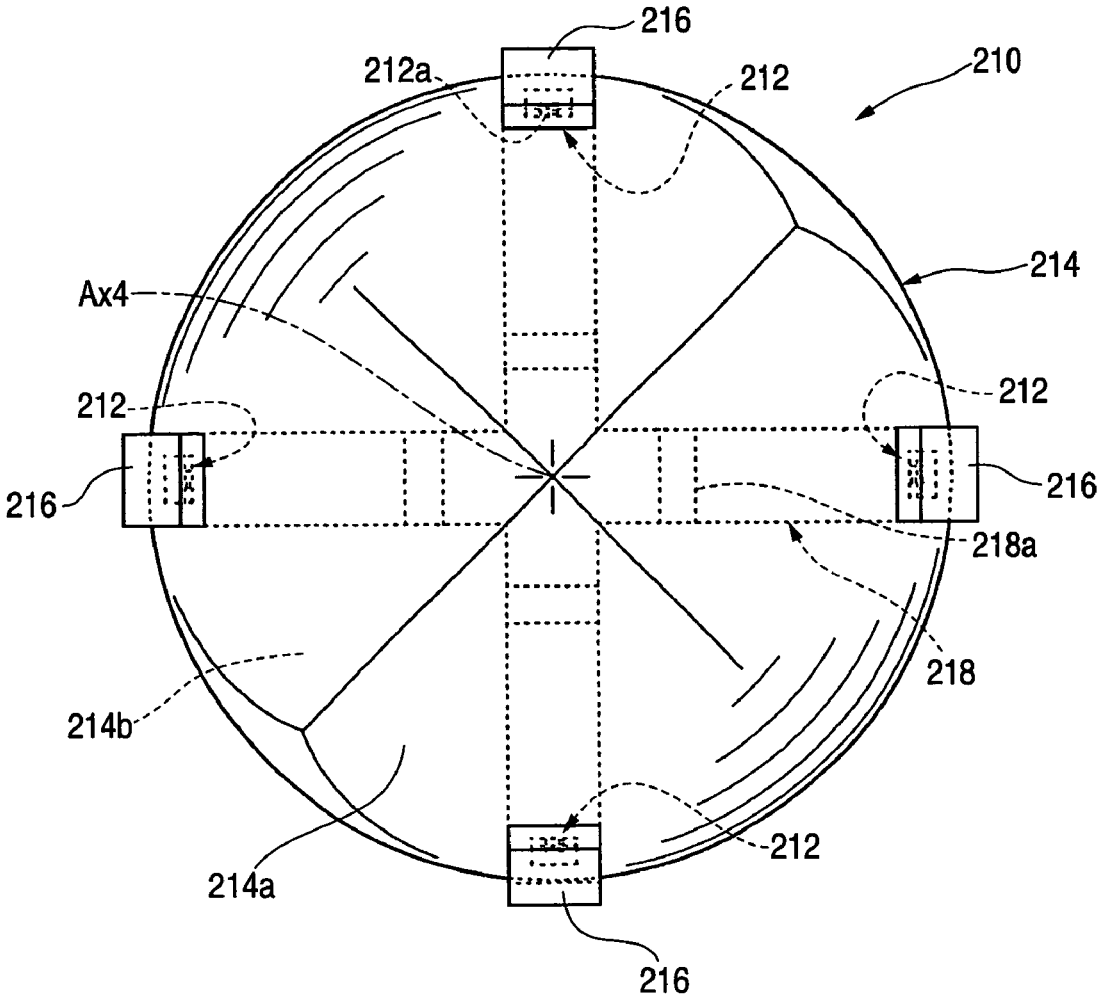
FIG. 12 is a plan view showing a lamp unit according to a second modified example of the present invention.
Figure 13:
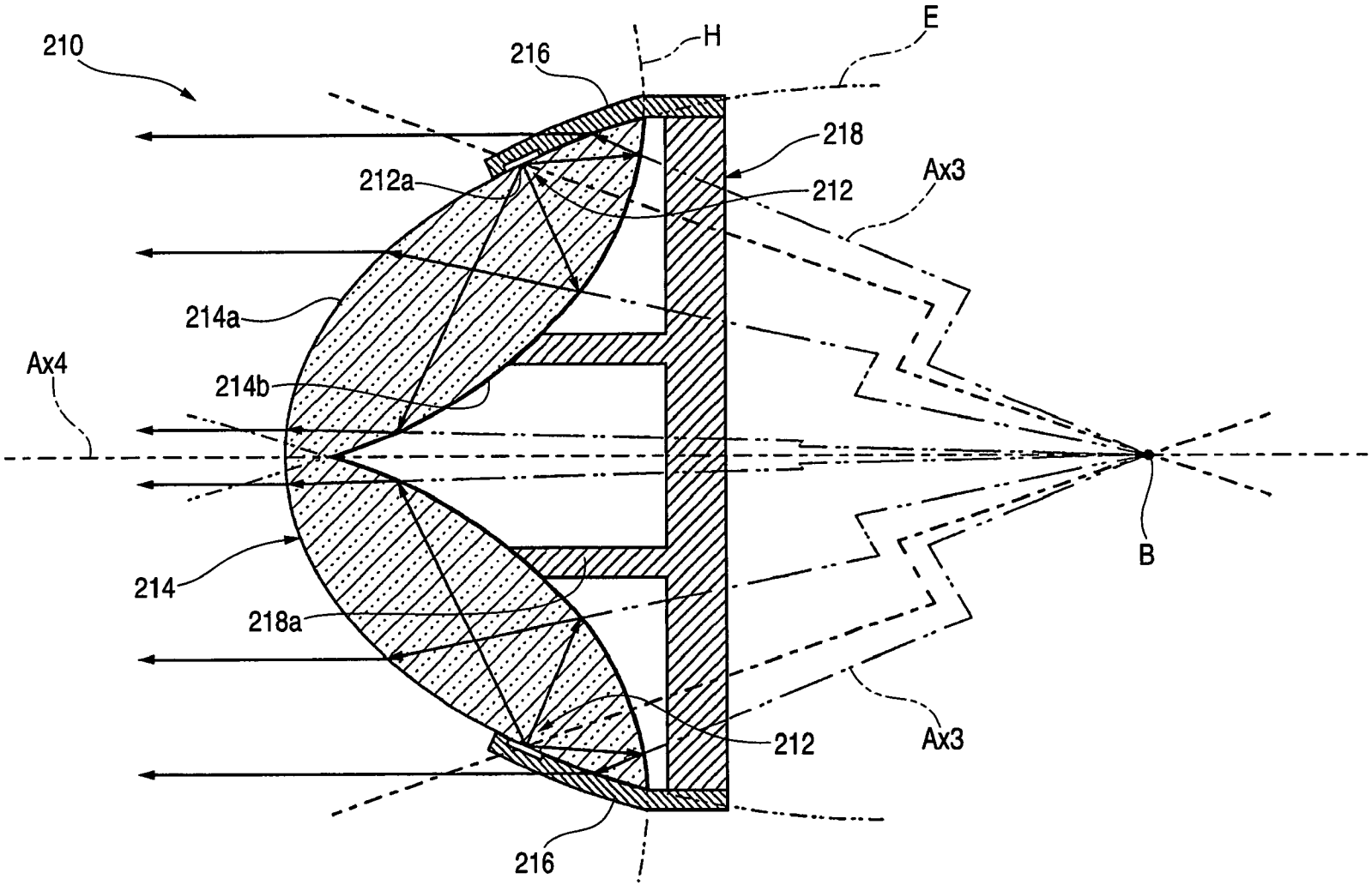
FIG. 13 is a side sectional view showing the lamp unit according to the second modified example of the present invention.

Next, the second modified example of the aforesaid embodiment will be explained. FIG. 12 is a front view showing a lamp unit 210 according to this modified example, and FIG. 13 is a side sectional view thereof.

As shown in these figures, the lamp unit 210 is configured by a light emitting element 212, a translucent member 214 and a supporting bracket 216.

The configuration of the light emitting element 212 itself is substantially similar to the light emitting element 52 of the lamp unit 50 of the aforesaid embodiment.

The translucent member 214 is made of transparent resin like the translucent member 54 of the lamp unit 50, and the rear surface of the translucent member is configured as a reflecting surface 214*b* which reflects, on the inner surface thereof, the light incident into the translucent member 214 from the light emitting element 212, whilst the front surface of the translucent member is configured as an irradiating surface 214*a* which emits light, irradiated from the light emitting element 212 and then reflected by the inner surface of the reflecting surface 214*b*, in the forward direction of the lamp unit from the translucent member 214.

The surface configurations of the reflecting surface 214*b* and the irradiating surface 214*a* of the translucent member 214 are partially the same as the reflecting surface 54*b* and the irradiating surface 54*a* of the translucent member 54. However, the outer configuration of the reflecting surface and the irradiating surface of the translucent member 214 are different from those of the reflecting surface and the irradiating surface of the aforesaid embodiment. Further, the number of each of the light emitting element 212 and the supporting bracket 216 differs from those of the light emitting element and the supporting bracket of the aforesaid embodiment.

That is, this modified example is arranged such that the lamp unit 50 of the aforesaid embodiment is disposed at four positions placed with an interval of 90 degrees therebetween around the center axis Ax4 and the mutually overlapped portions of the translucent members 54 of the four lamp units 50 are integrated.

The supporting brackets 216 are fixedly supported at the respective tip end portions of a supporting frame 218 of a cross shape which is disposed near the rear side of the translucent member 214. The supporting frame 218 is provided with projection portions 218*a* which position and support the translucent member 214 at four portions of the rear surface thereof.

The lamp unit 210 according to this modified example is also arranged in a manner that the light incident into the translucent member 214 from the light emitting element 212 is reflected by the inner surface of the reflecting surface 214*b* of the translucent member 214 as spread light emitted from the virtual image position B of a light emitting chip 212*a* and then irradiated from the irradiating surface 214*a* in the forward direction of the lamp unit as parallel rays along the center axis Ax4.

Also, in the case of employing the configuration of this modified example, the utilization factor of light from the light emitting element 212 can be enhanced, and not only the irradiation light from the lamp unit 210 can be controlled accurately but also the length of the lamp unit in the longitudinal direction of a vehicle can be made short.

Further, when the lamp unit is configured with the four light emitting elements 212 as in this modified example, a sufficient amount of irradiation light can be secured.

Figure 14:
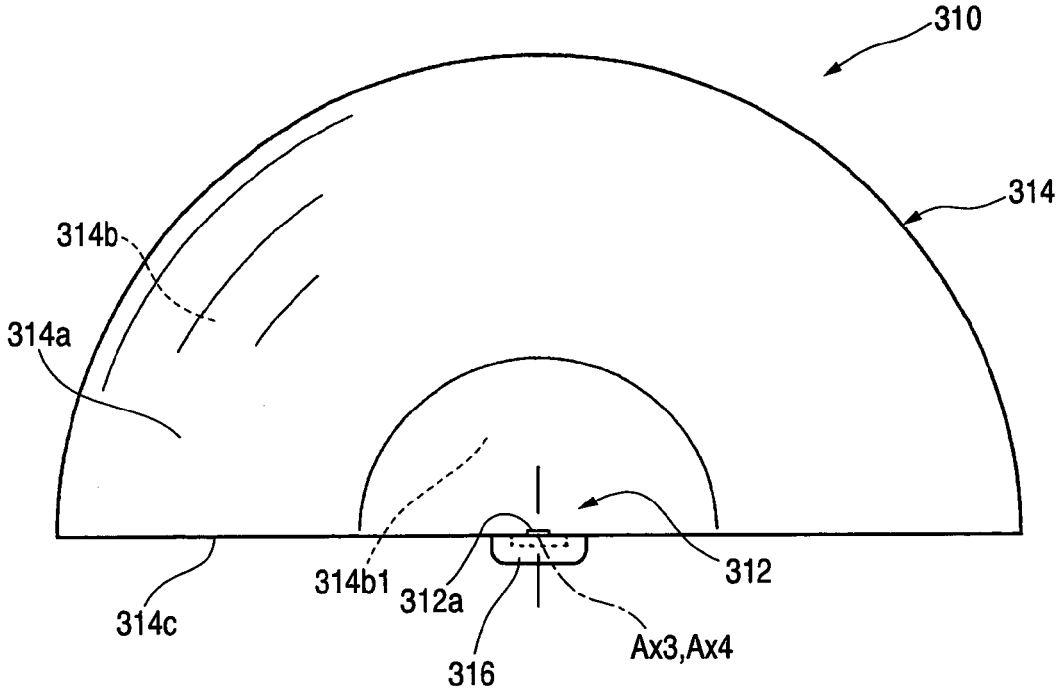
FIG. 14 is a plan view showing a lamp unit according to a third modified example of the present invention.
Figure 15:
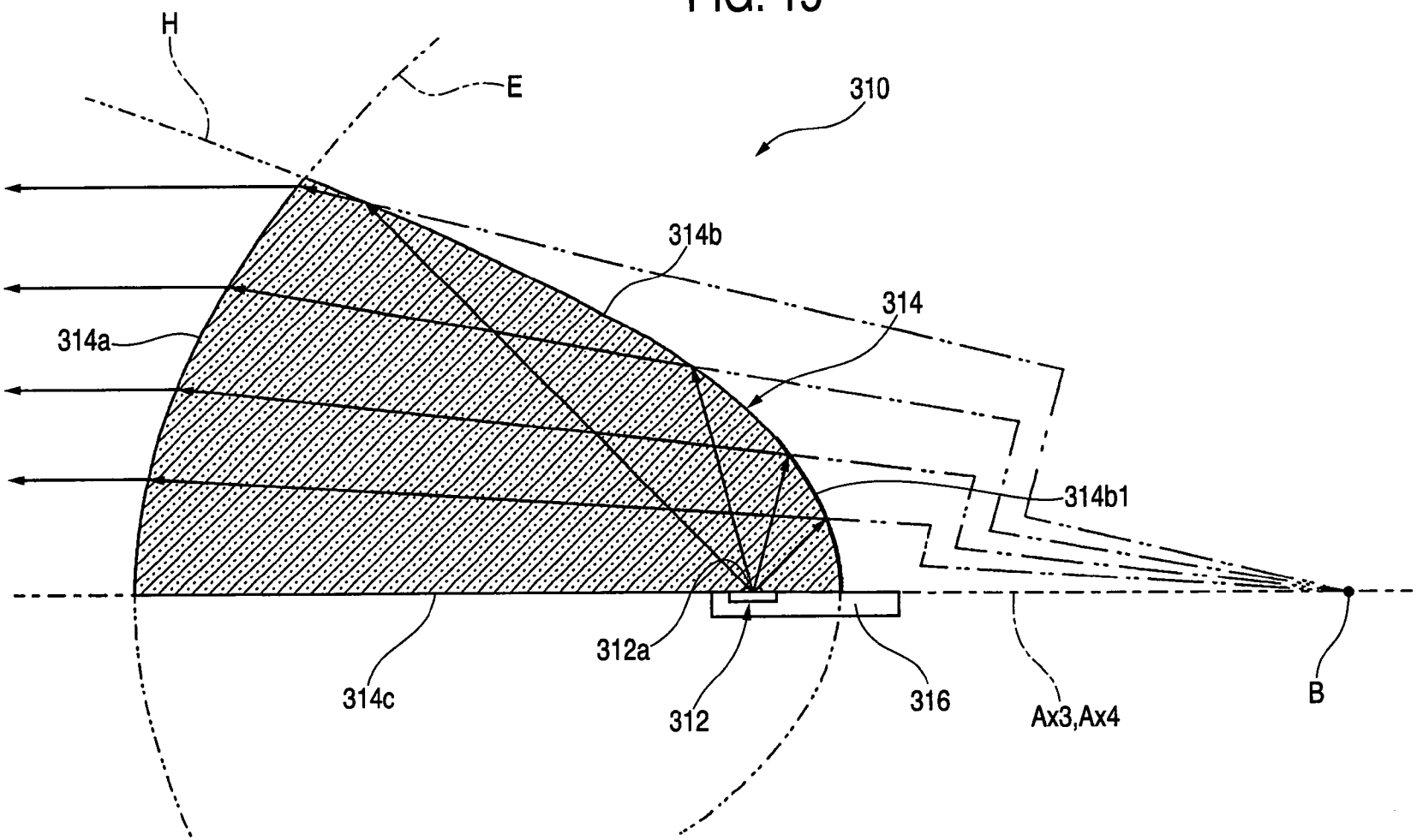
FIG. 15 is a side sectional view showing the lamp unit according to the third modified example of the present invention.

Next, a third modified example of the aforesaid embodiment will be explained. FIG. 14 is a front view showing a lamp unit 310 according to this modified example and FIG. 15 is a side sectional view thereof. The lamp unit 310 is configured by a light emitting element 312, a translucent member 314 and a supporting bracket 316.

The configuration of the light emitting element 312 itself is same as the light emitting element 52 of the lamp unit 50 of the aforesaid embodiment.

The translucent member 314 is made of transparent resin like the translucent member 54 of the lamp unit 50, and the rear surface of the translucent member is configured as a reflecting surface 314*b* which reflects, on the inner surface thereof, the light incident into the translucent member 314 from the light emitting element 312, whilst the front surface of the translucent member is configured as an irradiating surface 314*a* which emits light, irradiated from the light emitting element 312 and then reflected by the inner surface of the reflecting surface 314*b*, in the forward direction of the lamp unit from the translucent member 314.

In this case, the translucent member 314 is set in its outer configuration seen from the front side thereof to a semicircle of a bottom chord shape. Also, the light emitting element 312 is disposed upward on a portion near the rear end of the lower end plane 314*c* of the translucent member.

The surface configuration of the irradiating surface 314*a* of the translucent member 314 is substantially the same as that of the irradiating surface 54*a* of the translucent member 54. Further, although the surface configuration of the reflecting surface 314*b* of the translucent member 314 is formed by a hyperboloid of revolution like the reflecting surface 54*b* of the translucent member 54, the eccentricity e of the reflecting surface 314*b* is set to be smaller than that of the reflecting surface 54*b* of the translucent member 54. Furthermore, the center axis Ax3 of the hyperboloid of revolution constituting the reflecting surface 314*b* and the center axis Ax4 of the ellipsoid of revolution constituting the irradiating surface 314*a* are set as the same axis line and the light emitting element 312 is disposed on this axis line.

In this modified example, since the incident angle of the light incident into the reflecting surface 314*b* of the translucent member 314 from the light emitting element 312 becomes larger than the critical angle of the translucent member 314 as to the area of the reflecting surface other than an area 314*b*1 near the rear end thereof, the light is reflected by the inner surface of the reflecting surface in a total-reflection manner. Thus, the mirror surface processing for the rear surface of the translucent member 314 is performed only on the area 314*b*1 near the rear end of the reflecting surface 314*b*.

The supporting bracket 316 is a member made of metal that extends in the longitudinal direction of a vehicle along the surface 314*c* of the translucent member 314 and fixedly supports the light emitting element 312 at the front end portion of the supporting bracket.

The lamp unit 310 according to this modified example is also arranged such that the light incident into the translucent member 314 from the light emitting element 312 is reflected by the inner surface of the reflecting surface 314*b* of the translucent member 314 as spread light emitted from the virtual image position B of a light emitting chip 312*a* and then irradiated from the irradiating surface 314*a* in the forward direction of the lamp unit as parallel rays along the center axis Ax4.

In the case of employing the configuration of this modified example, although the length of the translucent member 314 in the longitudinal direction of a vehicle becomes longer than those of the aforesaid embodiment and the aforesaid modified examples, the utilization factor of light from the light emitting element 312 can be enhanced and the irradiation light from the translucent member 314 can be controlled accurately.

Further, according to this modified example, since the surface of the translucent member 314 is subjected to the mirror surface processing only at the area 314*b*1 near the rear end of the reflecting surface 314*b*, pure or crystal feeling can be provided to the translucent member 314.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A lamp unit for a vehicle, comprising:

a light emitting element that emits light; and a translucent member disposed to cover a forward side of the light emitting element, said translucent member comprising, an inner surface of the translucent member that reflects said emitted light that is incident into the translucent member from the light emitting element, and a reflecting irradiating surface of the translucent member that irradiates the reflected light in a forward direction of the lamp unit, wherein a vertical sectional shape of the reflecting surface, along a plane that passed through a light emitting center of the light emitting element, is concave and formed by a hyperbola having its focusing point substantially near the light emitting center, and the a vertical sectional shape of the irradiating surface along said plane is convex curved shape and formed by an ellipse having its focusing point substantially near a virtual image position of the light emitting element formed by the reflecting surface.

2. A lamp unit for a vehicle according to claim 1, wherein the light emitting element includes a light emitting chip and a sealing resin that seals the light emitting chip, and the sealing resin is integrally formed with the translucent member.

3. A lamp unit for a vehicle according to claim 1, wherein the reflecting surface is formed by a focal point of a hyperboloid of revolution that is conjugate with the reflecting surface.

4. A lamp unit for a vehicle according to claim 1, wherein the irradating surface is formed by an ellipsoid of revolution.

5. A lamp unit for a vehicle according to claim 1, wherein a substantially entire area of the surface of the translucent member comprises the reflecting surface and the irradiating surface.

6. A lamp for a vehicle, said lamp comprising a plurality of lamp units housed in a lamp chamber, said plurality of lamp units comprising:

a first lamp unit of a projector type, including a substantially transparent projection lens on an optical axis, a first light emitting element positioned at a rear side of said projection lens, and a reflector covering an upper side of said first light emitting element to direct emitted light in a forward direction toward said projection lens;

at least one second lamp unit comprising a second light emitting element that directs light backwards to a translucent member having a reflecting surface that receives and reflects said emitted light from the second light emitting element towards an irradiating surface of said translucent member and in a forward direction of the lamp unit.

7. The lamp of claim 6, where a shape of said reflecting surface of said at least one second lamp unit is concave and formed by a hyperbola such that a virtual image of light is formed at a focal point of a hyperboloid of revolution that is conjugate with said reflecting surface.

8. The lamp of claim 6, wherein said reflector of said first lamp unit is substantially elliptical and has an increasing eccentricity from the vertical section toward a horizontal section thereof.

9. The lamp of claim 6, wherein said irradiating surface has a convex shape formed by an ellipse having an eccentricity that is reciprocal of a refractive index of the translucent member.

10. The lamp of claim 6, wherein said irradiating surface is a substantially elliptical cylindrical or cylindroid surface.

11. The lamp of claim 10, where said reflecting surface is substantially concave and formed by a hyperbola such that a virtual image of light is formed at a focal point of a hyperboloid of revolution that is conjugate with said reflecting surface.

12. The lamp of claim 10, wherein said reflecting surface is a substantially hyperbolic cylindrical surface.

13. The lamp of claim 6, wherein an outer configuration of said reflecting surface is circular and is a hyperboloid of revolution, and an outer configuration of said irradiating surface is circular and is an ellipsoid of revolution, wherein said reflecting surface and said irradiating surface share a common axis through a center of said translucent member, and further wherein said light emitting element is positioned at said center of said translucent member.

14. The lamp of claim 6, wherein said light emitting element comprises a plurality of substantially equally spaced light emitting devices.

15. The lamp of claim 6, wherein said translucent member has a semicircular shape, a chord of said translucent member with said semicircular shape is positioned at its bottom, and said light emitting element is positioned at said bottom of said translucent member and substantially on said chord.

16. The lamp of claim 6, wherein said light emitting element comprises a white light emitting diode.

17. A lamp for a vehicle, said lamp comprising a plurality of lamp units housed in a lamp chamber, said plurality of lamp units comprising:

a first lamp unit of a projector type, including a substantially transparent projection lens on an optical axis, a first light emitting element positioned at a rear side of said projection lens, and a reflector covering an upper side of said first light emitting element to direct emitted light in a forward direction toward said projection lens;

a plurality of second lamp units, each comprising a second light emitting element that directs light backwards to a translucent member having a reflecting surface that receives and reflects said emitted light from the second light emitting element towards an irradiating surface of said translucent member and in a forward direction of the lamp unit, including, a first one of said second lamp units having a concave shape of said reflecting surface and formed by a hyperbola such that a virtual image of light is formed at a focal point of a hyperboloid of revolution that is conjugate with said reflecting surface, wherein said irradiating surface has a convex shape formed by an ellipse having an eccentricity that is reciprocal of a refractive index of the translucent member, a second one of said second lamp units, wherein said irradiating surface is a substantially elliptical cylindrical or cylindroid surface and said reflecting surface is substantially concave and formed by a hyperbola such that a virtual image of light is formed at a focal point of a hyperboloid of revolution that is conjugate with said reflecting surface, and a third one of said second lamp units, wherein wherein said irradiating surface is a substantially elliptical cylindrical or cylindroid surface and said reflecting surface is a substantially hyperbolic cylindrical surface.

18. The lamp of claim 17, wherein for at least one of said plurality of second lamp units, an outer configuration of said reflecting surface is circular and is a hyperboloid of revolution, and an outer configuration of said irradiating surface is circular and is an ellipsoid of revolution, wherein said reflecting surface and said irradiating surface share a common axis through a center of said translucent member, and further wherein said light emitting element is positioned at said center of said translucent member.

19. The lamp of claim 17, wherein for at least one of said plurality of second lamp units, said light emitting element comprises a plurality of substantially equally spaced light emitting devices.

20. The lamp of claim 17, wherein for at least one of said plurality of second lamp units, said translucent member has a semicircular shape, a chord of said translucent member with said semicircular shape is positioned at its bottom, and said light emitting element is positioned at said bottom of said translucent member and substantially on said chord.

* * * * *